United States Patent [19]

Clark

[11] Patent Number: 4,743,207

[45] Date of Patent: May 10, 1988

[54] SPACE COMPATIBLE ELECTRICAL CONNECTOR

[75] Inventor: Thomas A. Clark, Santa Monica, Calif.

[73] Assignee: G & H Technology, Inc., Santa Monica, Calif.

[21] Appl. No.: 25,988

[22] Filed: Mar. 16, 1987

[51] Int. Cl.[4] ..... H01R 13/625

[52] U.S. Cl. ..... 439/317

[58] Field of Search ..... 439/312, 313, 314, 315, 439/316, 317, 318, 319, 332, 333, 334, 335, 336, 337, 338, 286

[56] References Cited

U.S. PATENT DOCUMENTS

| | | | |
|---|---|---|---|
| 2,092,904 | 9/1937 | Brugger | 439/312 |
| 2,825,882 | 3/1958 | Mitchell | 439/314 |
| 3,252,124 | 5/1966 | Hansen | 439/294 |
| 4,146,288 | 3/1979 | Ramsay et al. | 439/316 |
| 4,183,605 | 1/1980 | Arneson | 439/315 |

*Primary Examiner*—John McQuade

*Attorney, Agent, or Firm*—George J. Netter

[57] ABSTRACT

A plug and receptacle electrical connector releasably engageable to interconnect corresponding pairs of cable wires through included electrical contacts has one of the connector parts with a coded set of keys on an outer surface and the other connector part with an opening, the flange edge of which is formed with a corresponding coded set of keyways so as to accept the keyed connector part therewithin. Relative rotation of the connector parts locks the flanged edge behind the keys mating the connector parts. One of the connector parts has a pair of pressure-applying members which extend radially outwardly from the connector part at a substantial angular separation from one another, and the other connector part has first and second pressure-applying members extending radially outwardly from the other connector part at a mutual angle less than that of the pressure applying members on the first connector part. The pressure applying members can be manipulated by the use of one hand alone.

6 Claims, 2 Drawing Sheets

FIG. 1
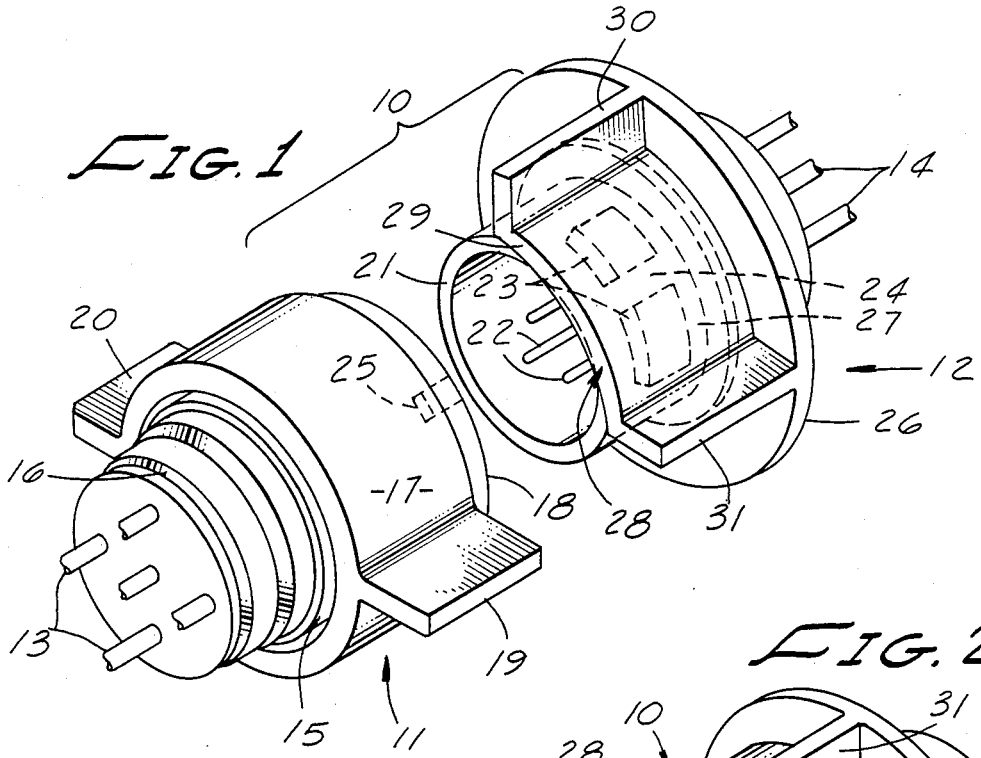
FIG. 2
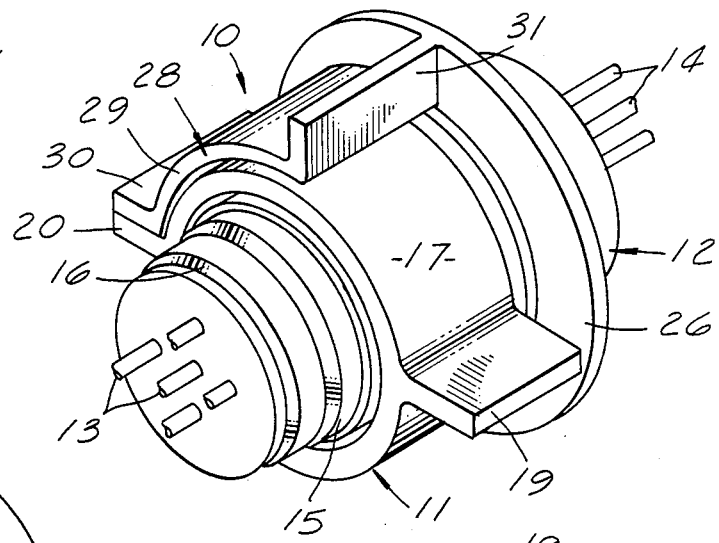
FIG. 3
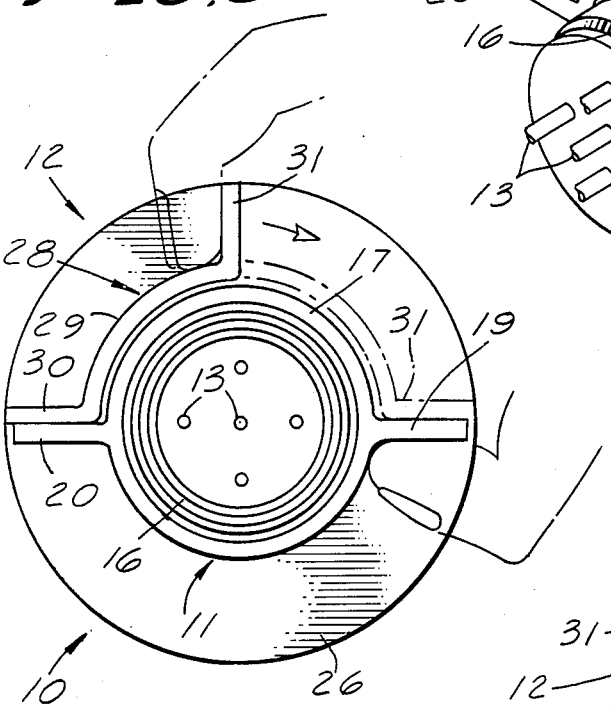
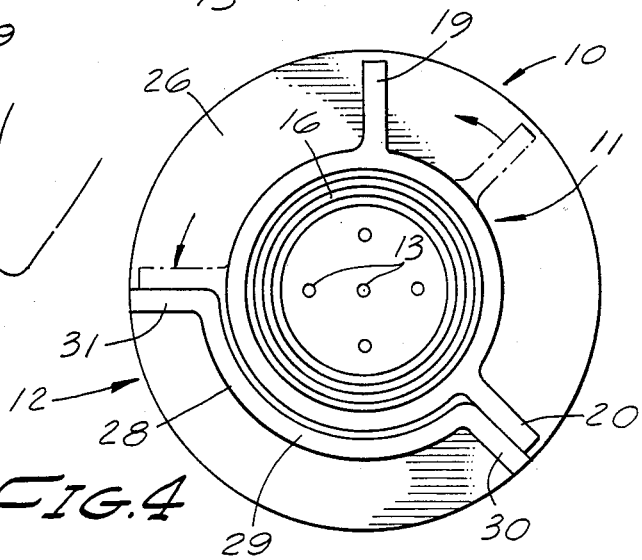
FIG. 4

SPACE COMPATIBLE ELECTRICAL CONNECTOR

The present invention relates generally to releasable electrical connectors, and, more particularly, to a releasable electrical connector which is mated and unmated in a manner confining mating, unmating and reaction forces to the connector parts and the operator's hand.

BACKGROUND

A releasable electrical connector which finds considerable use both for domestic and defense purposes, a well as in the space environment, consists of a plug and receptacle which are releasably secured together to interconnect pairs of cable wires by relative rotation of the connector parts. Quite frequently the receptacle will be fixedly mounted to a wall or panel and the plug is related to the receptacle by rotating a locking ring carried by the plug part to draw the plug and receptacle together or apart, depending upon the direction of rotation. In this situation an individual standing closely adjacent the connector parts, upon rotating the connector ring, will normally present a reaction force via his body into the floor upon which he stands. Although this may be negligible in many circumstances, under weightless conditions in space, or example, such reaction forces must be carefully compensated for or the weightless individual attempting to mate or unmate a connector will find that the forces being applied to the connector do not effect opening or closing of the connector, but produce unintended results.

There are other circumstances in which spatial constraints make it difficult to use both hands in actuating a connector, and, therefore, make it advisble to have means as a part of the connector enabling one-hand connector opening and closing.

A well received electrical connector and one to which the primary advantages of the present invention are especially applicable is that disclosed in U.S. Letters Pat. No. 4,183,605, Electrical Connector With Arcuate Detent Means by Hal Arneson assigned to the same assignee. The patented connector includes a plug and receptacle joinable together by a rotatable locking ring carried on the plug, which has parts thereof that are anchored behind keys on the receptacle for pulling the two connector parts together during mating or separating the same during unmating.

OBJECTS AND SUMMARY OF THE PRESENT INVENTION

It is a primary object and aim of the present invention to provide a releasable electrical connector having improved means manipulatable to mate or unmate the connector parts, depending upon the direction of manipulation with the applied force and reaction thereto remaining in the connector parts.

A further object is the provision of a releasable electrical connector which can be mated and unmated by the use of one hand alone.

In the practice of the present invention there is provided a plug and receptacle electrical connector releasably engageable to interconnect corresponding pairs of cable wires through included electrical contacts. One of the connector parts has a coded set of keys on an outer surface and the other connector part has an opening, the flange edge of which is formed with a corresponding coded set of keyways so as to accept the keyed connector part therewithin. Relative rotation of the connector parts locks the flanged edge behind the keys mating the connector parts.

One of the connector parts includes a pair of pressure-applying members which extend radially outwardly from the connector part at a substantial angular separation from one another. The other connector part also includes first and second pressure-applying members extending radially outwardly from the other connector part at a mutual angle less than that of the pressure applying members on the first connector part.

When the two connector parts are axially received on each other during mating, for example, the two pairs of pressure-applying members of the respective connector parts fit together and are aligned radially with one another. Pressure may now be applied by hand, for example, onto an opposed pair of pressure applying members on the plug and receptacle, moving them towards one another producing relative rotation between the connector parts locking the flanged edge of the connector part behind the keys of the other connector part. When it is desired to unmate the connector, the opposite two pressure-applying members are manipulated so as to apply a force moving them towards one another, which effects rotation of the connector parts in the opposite direction, unthreading and releasing the connector parts from one another.

In a further version of the invention, the first pair of pressure-applying members are affixed to the connector part and the second pair of members are secured to a coupling ring rotatably mounted on the same connector part.

DESCRIPTION OF THE DRAWING

FIG. 1 is a perspective view showing the connector parts of a releasable connector constructed in accordance with this invention separated from one another.

FIG. 2 shows the connector parts of FIG. 1 mated.

FIG. 3 shows an end elevational view of the connector of FIG. 2 immediately prior to applying opening or releasing force thereto.

FIG. 4 is a view similar to FIG. 3 showing the various force application directions for opening and closing the connector.

DESCRIPTION OF PREFERRED EMBODIMENTS

Figure 5:
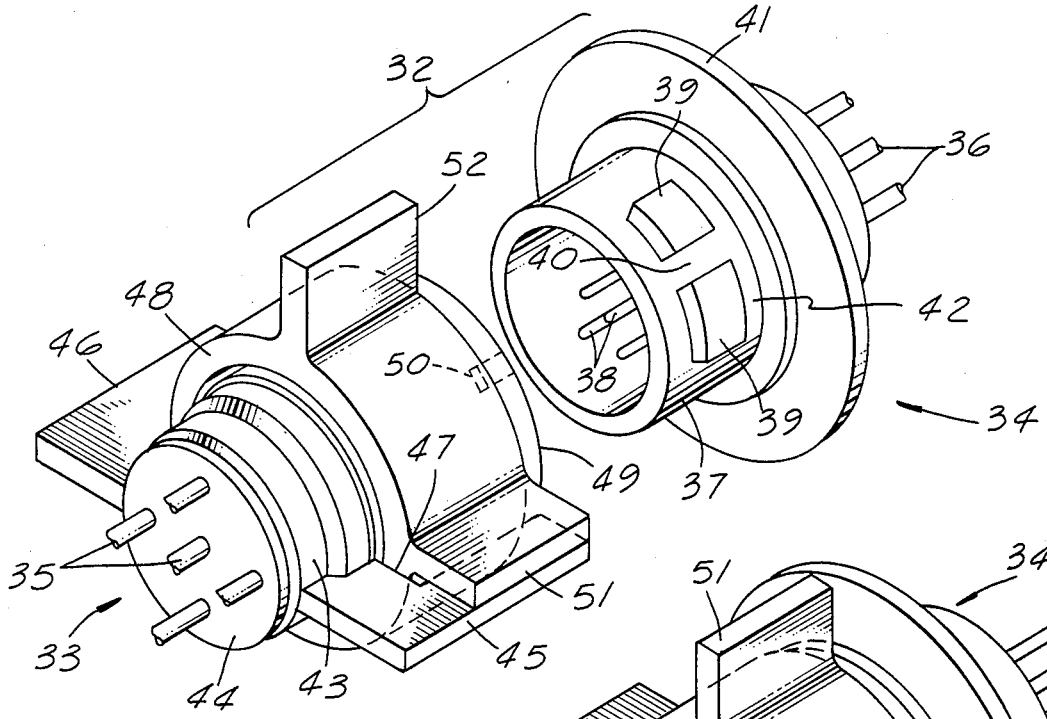
FIG. 5 is a perspective view of connector parts, modified in accordance with a further form of this invention.

For the ensuing description of a first embodiment of the present invention, reference is now made to FIGS. 1–4 in which an electrical connector embodying the features of this invention is enumerated generally as 10, and is seen to include in its major elements a plug part 11 and receptacle part 12, which interconnect via included contacts pairs of cable wires 13 and 14. Although typically one of the connector parts, such as the receptacle 12, is fixedly mounted to a wall or panel and the other connector part {plug} is releasably joined to the fixedly mounted part, in the present circumstances we are concerned with an electrical connector in which neither of the parts are fixedly mounted, but instead either can be rotated or moved at will. More particularly, the invention to be described herein is especially advantageous for use in circumstances where either or both of the connector parts are movable and the available space for manipulating the connector parts is limited, such as, for example, in a space capsule. Also, the invention is particularly advantageous where the forces that must be applied to the connector parts for mating and unmating should preferably be confined to the connector parts and the operator's hand since rotation through the equipment or body of the individual actuating the mating and unmating of the connector would be undesirable, such as, for example, in a space capsule where weightlessness would make it necessary for the individual to counteract such force reactions. That is, with respect to this latter point, forces needed to separate and join the connector parts in accordance with the present invention are confined to the connector parts themselves and the operator's hand, and have no significant external reaction forces.

The plug connector part 11 includes a generally cylindrical shell 15 unitarily secured about an insulative insert 16 within which the cable wires 13 and electrical contacts (not shown) are mounted. A coupling ring shell 17 is mounted onto the plug shell 15 for axial rotation thereabout and has an open outer end 18 via which the receptacle 12 is received during mating. More particularly, the edgewall defining the opening of the shell 17 includes one or more keys 25.

The outer surface of the shell 17 includes first and second platelike members 19 and 20 extending radially outwardly from the shell surface and arranged about the shell axis at a large angle with respect to each other, preferably about 180 degrees. The shell 17 and the members 19 and 20 are unitarily related such that rotation of the shell 17 by applying pressure to either or both of the members 19 and 20 produces a concomitant rotation about the inner plug shell 15 and included contacts.

The receptacle 12 consists generally of a hollow metal shell 21 within which the conventional connector parts, consisting of an insulated insert and one or more electrical pin contacts 22, are received. The shell is of such outer diameter as to enable receipt within the open end of the coupling ring 17 and plug shell 15. Additionally, the outer peripheral surface of the receptacle shell 21 includes two or more keys 23 arranged spaced apart at a predetermined angular arrangement about the receptacle shell axis with one or more keyways 24 along which a coupling ring shell key 25 passes on mating of the connector parts.

A radially outwardly extending flange 26 is unitarily secured to the receptacle shell 21 at a point spaced outwardly of the keys 23 providing an open passageway or groove 27 between the keys and the adjacent flange surface.

An actuator plate 28 has an edge affixed {e.g., welded} to the forward facing surface of the flange 26 and includes a central curved portion 29 which is spaced from and generally parallel to the outer surface of the shell 21. Two end portions 30 and 31 of the plate are formed radially outwardly from the central plate portion 29. These members 30 and 31 as will be more particularly described, as force application means for rotating the receptacle 12 and coupling ring 17 during mating and unmating of the connector. The space between the inner surface of the plate 29, the keys 23 and the peripheral outer surface of receptacle shell 21 is such as to enable the receptacle shell 21 to be received within the plug and in that way to locate the coupling ring shell 17 within this space. At that time, the connector parts are arranged as shown in FIG. 2, with the plate 28 overlying, but slightly spaced from, the outer surface of the coupling ring. The mutual angular spacing of the members 30 and 31 is an angle less than that existing between the coupling ring shell members 19 and 20, or preferably about 90 degrees.

When the plug and receptacle connector parts are to be mated and starting from a position as shown in FIG. 1, they are moved toward one another along their respective cylindrical axes which are held colinear so that the receptacle shell 21 is received within the open end of the coupling ring and the plug key 25 passes along keyway 24 on the reeptacle. This movement is continued until the pin contacts 22 are received within corresponding socket contacts {not shown} within the plug connector part and the plug key 25 is located within the passage or groove 27. At this time, the receptacle force applying member 30 and plug force applying member 20 can be gripped in one hand and be moved together, which serves to locate the plug key 25 behind one of the receptacle keys 23, thereby locking the two connector parts together. The entire assembly appears as shown in FIG. 2, with members 30 and 20 substantially in contact and the members 31 and 19 being spaced apart approximately 90 degrees. When it is desired to unmate the connector from the position shown in FIG. 2, the force applying member 31 of the receptacle and the member 19 on the plug are gripped {FIG. 3}and moved toward each other, which, in effect, brings the plug key 25 back into alignment with the keyway 24 on the receptacle, enabling the two connector parts to be axially separated.

It is important to note that in both mating and unmating of the connector, for every force applied to a connector part there is an equal opposite force applied through the operator's hand to the other connector part, thereby leaving substantially no resultant force acting through the body of the individual who is actuating the connector parts. Accordingly, where there would be a situation such as weightlessness in a space capsule, the problem of a resultant force acting through the body of the individual would not have to be dealt with. Also, for both mating and unmating, it can be accomplished one-handed which can be advantageous when the connector is located in a spatially constrained place. Although it is contemplated that this invention may be advantageously employed with connector of any size, it is especially advantageous for connectors which can be encompassed by one hand and do not require opening or closing forces beyond that which can be exerted through the fingers of one hand.

Figure 6:
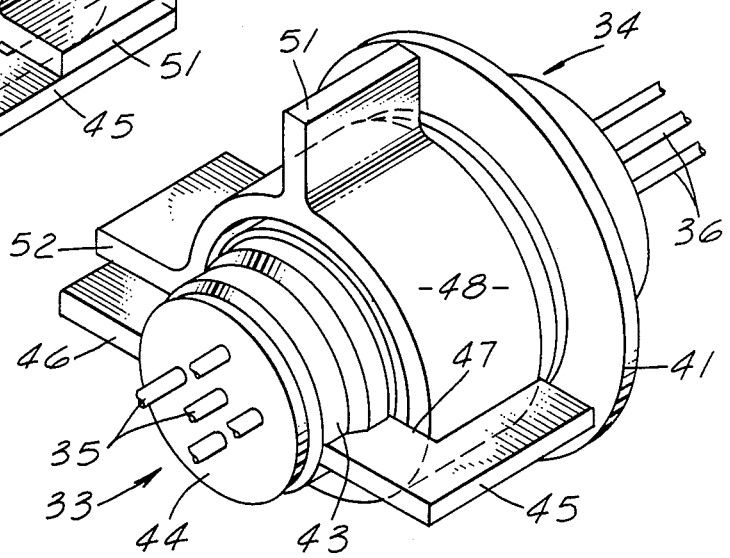
FIG. 6 shows the connector parts of FIG. 5 mated.
Figure 7:
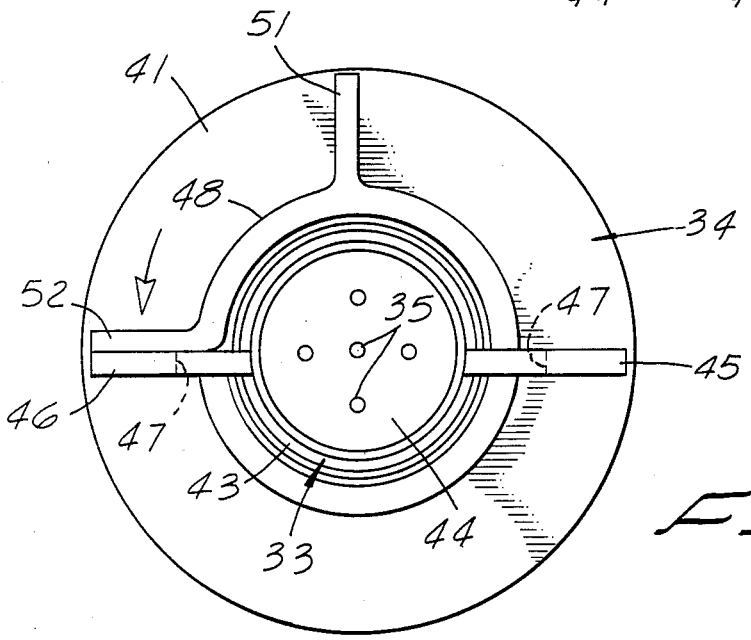
FIG. 7 is an end elevational view of the connector of FIG. 6.

For the following description of an alternative embodiment of the invention, reference is now made to FIGS. 5, 6 and 7. As in the first described embodiment, the releasable connector enumerated as 32 consists in its major parts of a plug 33 and receptacle 34, which are releasably joined to effect connection between corresponding pairs of cable wires 35 and 36.

The receptacle 34 differs from the receptacle 12 of the first embodiment essentially in not having the plate 28 or an equivalent thereto. That is, the receptacle 34 includes a generally cylindrical shell 37 within which a set of contacts 38 {e.g., pin contacts} are mounted within insulative inserts and connected by soldering or crimping to the cable wires 36. The peripheral surface of the cylindrical shell 37 includes two or more keys 39 spaced apart by keyway 40 in accordance with a predetermined arrangement which coacts with a similarly coded arrangement of keys and keyways on the inner surface of the plug 33 to insure that only a proper plug and receptacle can be mated together. A circular flange 41 is located just beyond the keys 39 to provide a space or groove 42 therebetween.

The plug 33 includes a cylindrical plug shell 43, which contains an insulative insert 44 within which electrical contacts {not shown} are arranged in a pattern corresponding to those of pin contacts in the receptacle such that the two connector parts may be mated by axial engagement. First and second force applying plates 45 and 46 are unitarily secured to the plug shell 43 and extend outwardly therefrom with mutual angular separation being approximately 180 degrees. A portion of each of the plates 45 and 46 are cut out forming a slot 47 adjacent the plug shell.

A coupling ring 48 consists of a cylindrical metal shell, the inner diameter of which is such as to enable sliding and rotating receipt upon the plug shell 43. More particularly, the coupling ring fits within the slots 47 and is otherwise constrained to rotate about the plug shell 43, but is mounted as not to be axially removable from the plug shell. The open end 49 of the coupling ring 48 has an inner dimension such as to permit sliding receipt over the receptacle shell 37 and the keys 39 thereon. The internal surface of the coupling ring includes one or more keys 50 of such dimensions and so arranged angularly about the coupling ring axis as to enable fitting receipt within the receptacle keyway 40 during mating of the connectors.

First and second radially outwardly extending force application plates 51 and 52 are unitarily affixed to the coupling ring 48 and arranged at a predetermined angle with respect to each other smaller than that existing between the plug force applying plates 45 and 46, and preferably about 90 degrees. Accordingly, the plates 51 and 52 serve as to limit stops to rotation of the coupling ring 48 about the plug shell in that at an extreme in one direction the plate 52 abuts against plate 46, and in the other rotational extreme the plate 51 contacts plate 45. The confined angular extent of rotation provided by the plates 51 and 52 is such as to move the key 50 along groove 42 so as to be lockingly located between a receptacle key 39 and the adjacent flange 41 during mating of the connector parts.

To mate the connector depicted in FIGS. 5 through 7, the plug and receptacle are moved towards each other with the connector part cylindrical axes arranged colinear such that the included electrical contacts of the two parts are mated, which can be achieved in the form shown in FIG. 5 when the plates 45 and 51 are held together and the plug key 50 is aligned with the keyway 40 on the receptacle. When the two connector parts are fully received on each other and the plug key 50 has passed along the complete length of the keyway 40 and positioned within the groove 42, pressure applied to the other two plates 46 and 52 causes the coupling ring 40 to rotate, moving the key 50 into locking relationship behind a receptacle key 39. As already noted, full locking relationship is achieved when the two plates 46 and 52 abut one another.

This version, as well as the first described version, can be advantageously employed with connectors of any size, however, it is most advantageously and preferably applied to a connector which can be encompassed by one hand. Thus, to unmate the connector shown mated in FIG. 6, the hand reaches about the plug part and immediately adjacent parts of the cable, the fingers clampingly engage the pressure applying members 45 and 51 and the finger clamping pressure is applied thereto rotating the coupling ring 48 to a position locating the plug key 50 in alignment with the receptacle keyway 40. The connector parts may now be separated by merely applying an axial separating force.

What is claimed is:

1. An electrical connector including first and second connector parts which can be locked and unlocked by one hand, comprising:

the first connector part includes a metal shell having an open end for receiving an end portion of the second connector part therewithin, and first and second platelike members affixed to the metal shell outer surface at angularly spaced apart points and extending outwardly away from the shell outer surface;

the second connector part including a metal shell, an end portion of which metal shell is dimensioned to enable receipt within an end portion of the first connector part;

means carried by said first and second connector parts coacting to lock the connector parts to one another upon relative rotation of the connector parts in a first direction and to unlock the connector parts upon relative rotation in the opposite direction said means including, an actuator plate affixed to the outer surface of the second connector part having a central portion spaced from and generally parallel to the said shell, and two end portions which extend outwardly away from the central portion, said end portions of the actuator plate being separated an amount less then that between the platelike members on the first connector part;

said connector parts being locked together by gripping an actuator plate end portion and a platelike member with one hand forcing them toward each other, and said connector parts being unlocked by gripping the other actuator plate end portion and other platelike member with one hand and forcing them toward one another.

2. An electrical connector as in claim 1, in which the actuator plate end portions lie between the platelike members when the second connector part end portion is received within the first connector part shell, the actuator plate being rotatable between said platelike members from a first limit position at which the connector parts can be axially unmated to a second limit position at which the connector parts are locked together.

3. An electrical connector as in claim 1, in which the second connector part shell is cylindrical and includes an outwardly extending flange, the actuator plate central portion being affixed to said flange and formed to extend generally parallel to the second part shell outer surface with the actuator plate end portions extending radially outwardly.

4. An electrical connector as in claim 1, in which the means to lock the connector parts to one another includes one or more keys with intervening keyways on each of said connector part shells, the keys of said first connector part shell being located behind keys of said second connector part shell to releasably lock the connector parts together.

5. An electrical connector as in claim, 1 in which the first connector part shell platelike members are separated approximately 180 degrees and the actuator end portions are separated approximately 90 degrees.

6. An electrical connector having first and second connector parts which are locked and unlocked by relative rotation effected through manipulation with one hand, comprising:

the first connector part including a metal shell having an open end, and first and second force applying plates affixed to the outer surface of said first connector part shell angularly separated a predetermined amount;

a coupling ring fixedly and rotatably mounted to said first connector metal shell having first and second force application means extending outwardly therefrom and lying between the first connector part force applying plates, the angular spacing between the force application means being less than that of the force applying plates;

the second connector part including a metal shell, an end portion of which can be received within the coupling ring and first connector part shell open end; and means on said connector part shell coacting with means on said coupling ring for releasably locking the connector parts together when the coupling ring is at one extreme rotation position on the first connector part shell;

locking of the connector parts being effected by exerting pressure with one hand on a force applying plate and a force application means and unlocking of the connector parts is achieved by exerting pressure with one hand on the other force applying plate and force application means.

* * * * *